US005642699A

United States Patent [19]

Brown

[11] Patent Number: 5,642,699

[45] Date of Patent: Jul. 1, 1997

[54] ROTARY VALVE SYSTEM

[76] Inventor: Gary I. Brown, 3425 W. Maule, Las Vegas, Nev. 89118

[21] Appl. No.: 615,116

[22] Filed: Mar. 14, 1996

[51] Int. Cl.[6] ..... F01L 7/16

[52] U.S. Cl. ..... 123/190.2; 123/190.17

[58] Field of Search ..... 123/190.1, 190.2, 123/190.17, 190.6, 190.8

[56] References Cited

U.S. PATENT DOCUMENTS

| | | | |
|---|---|---|---|
| 4,198,946 | 4/1980 | Rassey | 123/190.2 |
| 4,333,427 | 6/1982 | Burillo et al. | 123/190.2 |
| 4,517,938 | 5/1985 | Krüger | 123/190.17 |
| 4,879,979 | 11/1989 | Triguero | 123/190 |
| 5,095,870 | 3/1992 | Place et al. | 123/190.4 |
| 5,111,783 | 5/1992 | Moore | 123/190.4 |
| 5,154,147 | 10/1992 | Moroki | 123/190.17 |
| 5,205,251 | 4/1993 | Conklin | 123/190.2 |
| 5,251,591 | 10/1993 | Corrin | 123/190.6 |
| 5,255,645 | 10/1993 | Templeton | 123/190.17 |
| 5,273,004 | 12/1993 | Duret et al. | 123/190.2 |

*Primary Examiner*—Erick R. Solis
*Attorney, Agent, or Firm*—Joseph N. Breaux

[57] ABSTRACT

A rotary valve system for a four stroke engine is provided. The rotary valve system includes: an engine having a plurality of cylinders, a crankshaft, a fuel injector and an exhaust manifold; an intake valve assembly rotatably mounted within the engine in communication between the fuel injector and the cylinders, the intake valve assembly forming a single transverse intake port adjacent each of the cylinders; and an exhaust valve assembly rotatably mounted within the engine in communication between the exhaust manifold and the cylinder, the exhaust valve assembly forming a single transverse exhaust port adjacent each of the cylinders, the exhaust valve assembly being located parallel to the intake valve assembly; the intake valve assembly and the exhaust valve assembly being operationally connected to the crankshaft.

1 Claim, 2 Drawing Sheets

ROTARY VALVE SYSTEM

TECHNICAL FIELD

The present invention relates to valve systems for internal combustion engines and more particularly to valve systems for internal combustion engines having an intake and exhaust rotary valve assembly.

BACKGROUND ART

Inherent to the operation of a reciprocating internal combustion engine is the requirement that it have a valve or valves for reliably communicating a mixture of fuel and air into the engine cylinders and for subsequently exhausting the products of combustion. A concurrent requirement is that such valves open and close during the appropriate periods in the operation of the cycle. The valves must also provide for a tight seal when they are in a closed position.

The common approach to the valve requirements of the reciprocating internal combustion engine is the use of one or more spring-loaded, tulip-shaped valve structures formed from metal. Each valve head seats tightly into a tapered opening, or port, in the head wall of the engine cylinder to seal the cylinder. This requires that the valve head have a very precise shape, with low tolerance for deviation from the design specification.

The valve includes an elongated stem which moves reciprocally in a guide, which is comprised of a bore in the cylinder head. A spring fits around the valve stem and is attached to the top of the stem. The spring is in compression and exerts an axial force which, in the absence of an opposing axial force on the end of the valve stem, is sufficient to keep the valve seated.

The end of the valve stem abuts one end of a pivoting rocker arm. The other end of the rocker arm abuts the end of a push rod. The push rod is reciprocally moved axially by a solid lifter which rides on a cam lobe on a camshaft. The camshaft is rotated by the engine crankshaft by means of a reduction gear or a gear and chain arrangement. Rotation of the crankshaft is thereby mechanically translated into an axial force on the valve stem which opposes the spring force. The force translated through a push rod when the lifter is riding on the high point of a lobe on the camshaft is sufficient to overcome the spring force and unseat the valve by pushing it into the cylinder.

This type of intake and exhaust valve has been widely adopted as the solution for the valving requirements of the internal combustion engine primarily because of the relative ease by which adjustments can be made for wear, reasonable manufacturing costs, and the proven reliability of the design. However, the intrinsic disadvantages of such valves and the necessary compromises in engine performance occasioned by their use are numerous.

It would be a benefit, therefore, to have a rotary valve assembly and system which increases engine performance over those with the heretofore mention valves. It would be a further benefit to have a rotary valve system which would replace the cam, lifters or followers, pushrods, rocker arms, tulip valves, valve springs, valve seats and keepers. It would be a still further benefit to have a rotary valve system providing a single intake port and a single exhaust port for each engine cylinder. It would be a further benefit to have a valve assembly capable of withstanding the harsh environment of an internal combustion engine.

GENERAL SUMMARY DISCUSSION OF INVENTION

It is thus an object of the invention to provide a rotary valve system that obviates the need for a cam, lifters, followers, pushrods, rocker arms, tulip valves, valve springs, valve seats and keepers.

It is a further object of the invention to provide a rotary valve system that improves engine performance over that of engines utilizing conventional valve assemblies.

It is a still further object of the invention to provide a rotary valve system that provides a single intake port and a single exhaust port for each engine cylinder.

It is a still further object of the invention to provide a rotary valve system that provides a protective coating over the valve assembly to protect the valve assembly from the harsh environment of an internal combustion engine.

Accordingly, a rotary valve system for a four stroke engine is provided. The rotary valve system includes: an engine having a plurality of cylinders, a crankshaft, a fuel injector and an exhaust manifold; an intake valve assembly rotatably mounted within the engine in communication between the fuel injector and the cylinders, the intake valve assembly forming a single transverse intake port adjacent each of the cylinders; and an exhaust valve assembly rotatably mounted within the engine in communication between the exhaust manifold and the cylinder, the exhaust valve assembly forming a single transverse exhaust port adjacent each of the cylinders, the exhaust valve assembly being located parallel to the intake valve assembly; the intake valve assembly and the exhaust valve assembly being operationally connected to the crankshaft.

In a preferred embodiment the intake port formed by the intake valve assembly intersects the longitudinal axis of the intake valve assembly. Further the exhaust port formed by the exhaust valve assembly intersects the longitudinal axis of the exhaust valve assembly.

The intake and exhaust valve bodies are operationally connected to the engine so that fluid communication is prevented between the exhaust manifold and the cylinder by the exhaust valve assembly during fluid communication between the fuel injector through the intake port formed by the intake valve assembly and the cylinder. Further fluid communication is prevented between the fuel injector and the cylinder during fluid communication between the cylinder through the exhaust port formed by the exhaust valve assembly and the exhaust manifold.

Preferably seals are mounted longitudinally along the intake valve assembly bracketing each of the open ends of the intake ports. Further the rotary valve system has seals mounted longitudinally along the exhaust valve assembly bracketing each of the open ends of the exhaust ports. More preferably, wave springs are mounted between the seals and the intake and exhaust valve bodies. The wave springs urge the seals outwardly from the valve bodies.

Preferably, the valve bodies have a protective covering. More preferably, the valve bodies are encased in a ceramic to protect them from the heat and friction.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
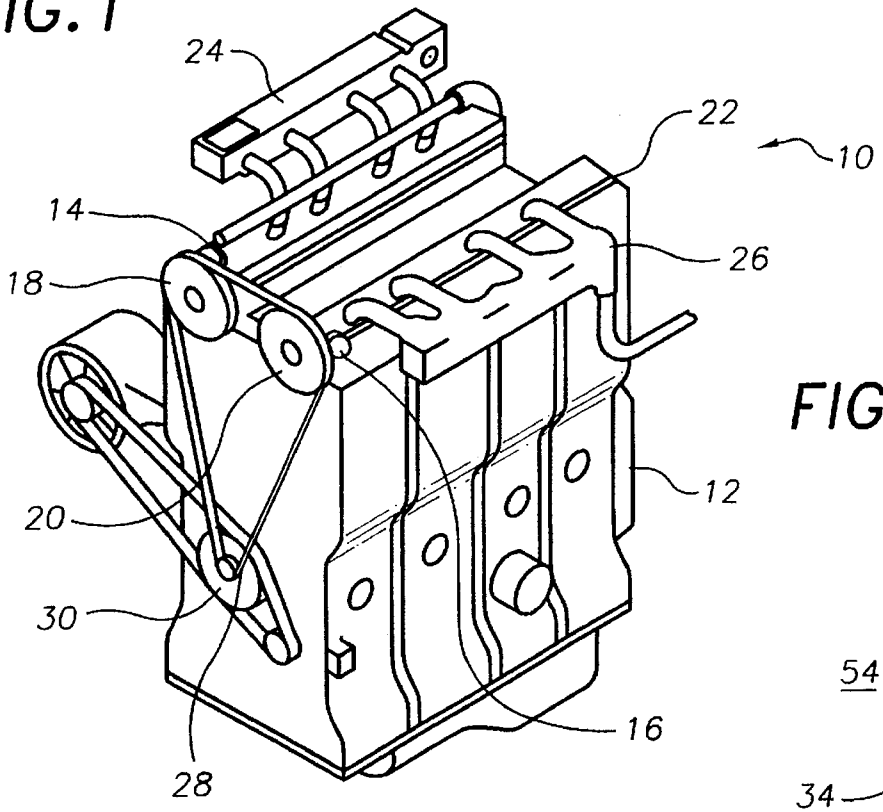
FIG. 1 is a perspective view of an exemplary embodiment of the rotary valve system of the present invention.

FIG. 1 is a perspective view of an exemplary embodiment of the rotary valve system of the present invention generally designated by the numeral 10 in a four cylinder, four stroke engine 12. Rotary valve system 10 includes an intake valve assembly 14, an exhaust valve assembly 16, a first belt pulley 18 and a second belt pulley 20.

Intake and exhaust valve assemblies 14, 16 are substantially identical in construction and dimension. Valve assemblies 14, 16 are rotatably mounted beneath the engine head 22, parallel to one another and above the cylinders (not shown). Intake valve assembly 14 is positioned so as to be in fluid communication between the fuel injectors 14 and each cylinder of engine 12. Exhaust valve assembly 16 is positioned so as to be in fluid communication between each cylinder of engine 22 and the exhaust manifold 26.

First belt pulley 18 is connected to intake valve assembly 14. Second belt pulley 20 is connected to exhaust valve assembly 16. Valve assemblies 14, 16 are operationally connected to the crankshaft (not shown) via flywheel 30 by a belt 28 connected between flywheel 30 and pulleys 18, 20. Pulleys 18, 20 are sized in relation to the connection with a flywheel 30 so that valve assemblies 14, 16 are rotated at a speed one-quarter of that of the crankshaft speed.

Figure 2:
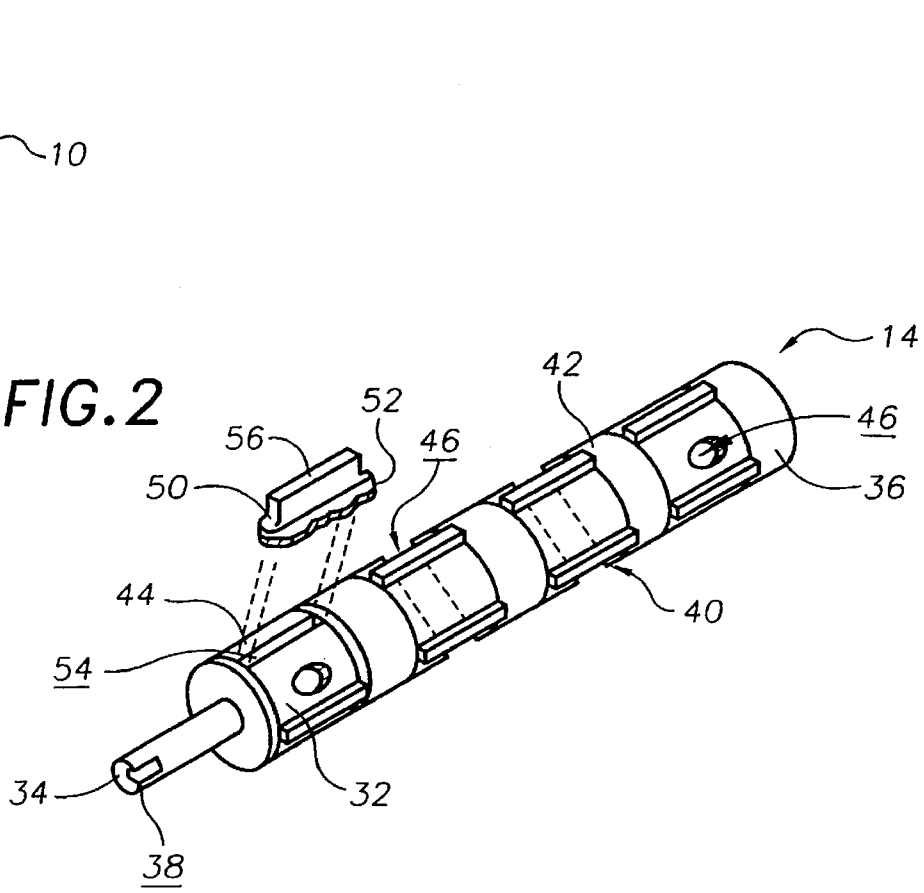
FIG. 2 is a partial cut-away, perspective view of a valve assembly.

FIG. 2 is a partial cut-away, perspective view of valve assembly 14 in isolation. Intake valve assembly 14 and exhaust valve assembly 16 are substantially identical in construction, therefore reference and identification of features of valve assembly 14 encompass reference and disclosure of exhaust valve assembly 16. In combination with FIGS. 3A through 3F, for convenience, reference will be additionally made to exhaust valve assembly 16.

Valve assemblies 14, 16 are constructed of an elongated core 32 formed of a hardened steel. Core 32 has a shaft end 34 and a blunt end 36. Shaft end 34 forms a keyway 38 for connecting belt pulleys 18, 20 (FIG. 1). Blunt end 36 is adapted for rotatably connecting to engine head 22 (FIG. 1).

Valve assemblies 14, 16 are divided into four cylinder sections 40. Each cylinder section 40 of valve assemblies 14, 16 is mounted adjacent a cylinder of engine 12 (FIG. 1). Cylinder sections 40 are bracketed by sealed bearing assemblies 42 to facilitate the rotation of valve assemblies 14, 16 while in operation. Valve bodies 14, 16 are further encased in a heat resistant ceramic shell 44 of silica alumina.

Through each cylinder section 40 of valve assembly 14 is formed an intake port 46. Exhaust ports 48, as shown in FIGS. 3A through 3F, are formed through exhaust valve assembly 16. Each port 46, 48 is formed transversely across valve assemblies 14, 16 so as to intersect the longitudinal axes thereof. When each valve assembly 14, 16 are mounted within engine 12, a single intake port 46 and a single exhaust port 48 is positioned adjacent to a cylinder 60 (FIGS. 3A–3F).

Bracketing each open end of ports 46, 48 are vane seals 50. Vane seals 50 are disposed atop steel wave springs 52 within slots 54 which are formed longitudinally along valve assemblies 14, 16. Vane seals 50 and wave springs 52 are secured within slot 54 by sealed bearing assemblies 42. Mounted atop each vane seal 50 is mounted a stainless steel strip 56.

FIGS. 3A through 3F comprise a sequential series of schematic drawings which show the rotational position of rotary valve system 10 of the present invention at various points in the operational cycle of a cylinder in a four cycle internal combustion engine.

Figure 3A:
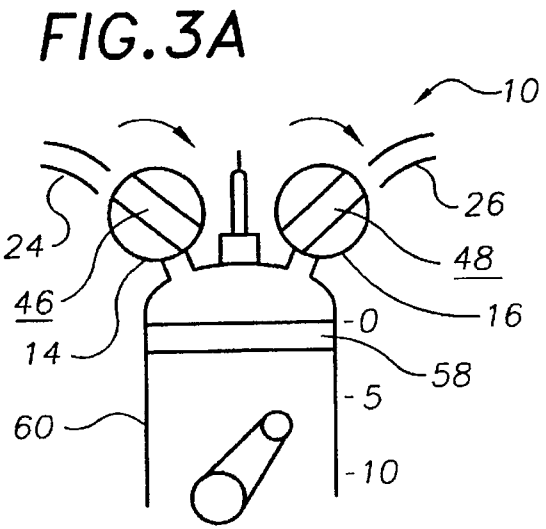
FIG. 3A through 3F comprise a sequential series of schematic drawings which show the rotational position of the rotary valve system of the present invention at various points in the operational cycle of a cylinder in a four cycle internal combustion engine.

FIG. 3A shows piston 58 positioned at top dead center (TDC) within cylinder 60, with the rotation of valve assemblies 14, 16 shown by the arrows. In this position, intake port 46 is in the closed position preventing fluid communication between fuel injector 24 and cylinder 60. At this same position, exhaust port 48 is in the closed position preventing fluid communication between cylinder 60 and exhaust manifold 26.

Figure 3B:
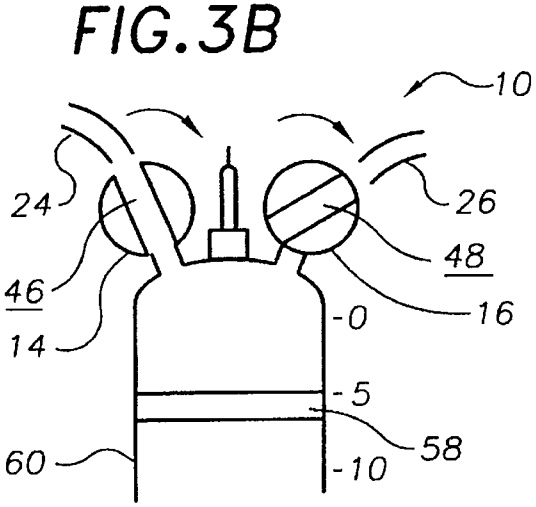

FIG. 3B shows piston 58 positioned at ninety degrees past TDC in the intake position within cylinder 60, with the rotation of valve assemblies 14, 16 shown by the arrows. In this position, intake port 46 is in the open position allowing fluid communication between fuel injector 24 and cylinder 60. Concurrently, exhaust port 48 is in the closed position preventing fluid communication between cylinder 60 and exhaust manifold 26.

Figure 3C:
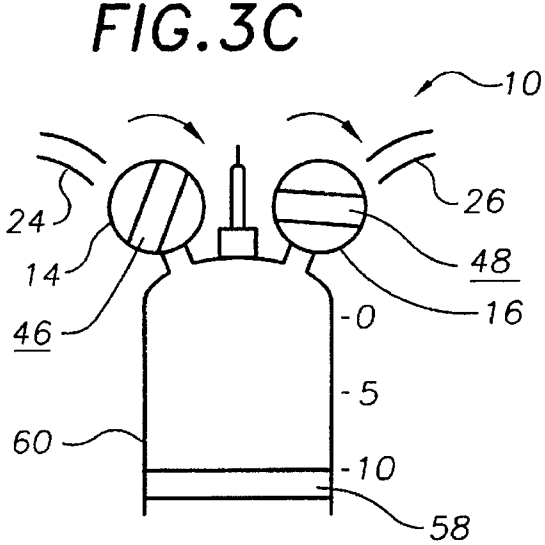

FIG. 3C shows piston 58 at bottom dead center (BDC) within cylinder 60 at the start of compression, with the rotation of valve assemblies 14, 16 shown by the arrows. At this position, intake port 46 is in the closed position preventing fluid communication between fuel injector 24 and cylinder 60. Concurrently, exhaust port 48 is in the closed position preventing fluid communication between cylinder 60 and exhaust manifold 26.

Figure 3D:
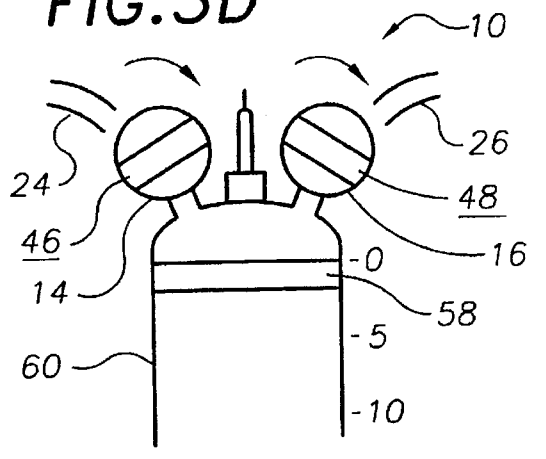

FIG. 3D shows piston 58 at TDC during the compression stroke within cylinder 60, with the rotation of valve assemblies 14, 16 shown by the arrows. At this position, intake port 46 is in the closed position preventing fluid communication between fuel injector 24 and cylinder 60. Concurrently, exhaust port 48 is in the closed position preventing fluid communication between cylinder 60 and exhaust manifold 26.

Figure 3E:
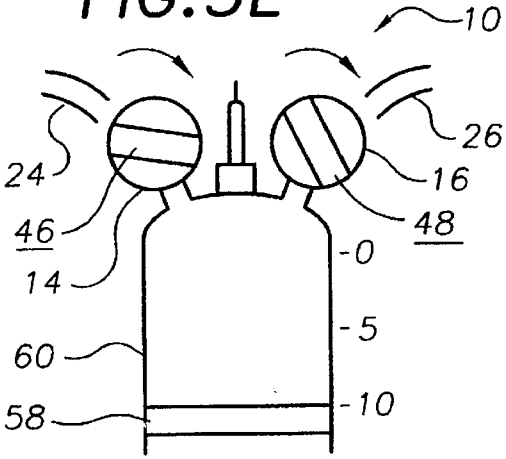

FIG. 3E shows piston 58 positioned at BDC during the power stroke, with the rotation of valve assemblies 14, 16 shown by the arrows. At this position, intake port 46 is in the closed position preventing fluid communication between fuel injector 24 and cylinder 60. Concurrently, exhaust port 48 is in the closed position preventing fluid communication between cylinder 60 and exhaust manifold 26.

Figure 3F:
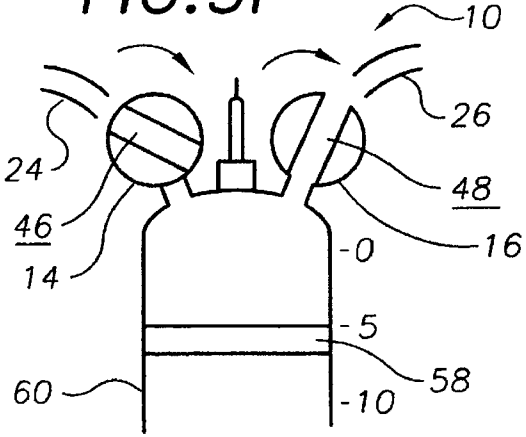

FIG. 3F shows piston 58 positioned at ninety degrees past BDC during the exhaust stroke, with the rotation of valve assemblies 14, 16 shown by the arrows. At this position, intake port 46 is in the closed position preventing fluid communication between fuel injector 24 and cylinder 60. Concurrently, exhaust port 48 is in the opened position allowing fluid communication between cylinder 60 and exhaust manifold 26.

It can be seen from the preceding description that a valve system for an internal combustion engine which obviates the need for a cam, lifters, followers, pushrods, rocker arms, tulip valves, valve springs, valve seats and keepers, improves engine performance over that of engines utilizing conventional valve assemblies, provides a single intake port and a single exhaust port for each engine cylinder, and provides a protective coating over the valve assembly to protect the valve assembly from the harsh environment of an internal combustion engine has been provided.

It is noted that the embodiment of the rotary valve system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a rotary valve system for an internal combustion engine having a plurality of combustion cylinders, a plurality of fuel injectors and a crankshaft, the improvement comprising:

a valve assembly rotatably mounted within said internal combustion engine engine in communication between said plurality of cylinders and said plurality of fuel injectors, said valve assembly being in operational connection with said crankshaft in a manner such. that rotation of said crankshaft causes said valve assembly to rotate; said valve assembly including an elongated core formed of hardened steel and having a shaft end and a blunt end, said shaft end having a key way formed therein for connection with a belt pulleys, said blunt end being adapted for rotatable connection with an engine head structure, said valve assembly being divided into four cylinder sections, each said cylinder section being mounted adjacent one of said plurality of cylinders of said engine, each said cylinder section being bracketed by a pair of sealed bearing assemblies to facilitate the rotation thereof, each said cylinder section having a port including two open ends formed transversely through said valve assembly so as to intersect the longitudinal axis thereof, and a pair of vane seals bracketing each said open end of each said port, each said vane seal being disposed atop a steel wave spring that is positioned within a slot formed longitudinally along an outer surface of said valve assembly and having a stainless steel strip mounted atop a surface thereof, each said vane seal and each said wave spring being secured within its respective said slot by a said pair of sealed bearing assemblies.

* * * * *